United States Patent [19]

Stern

[11] Patent Number: 5,052,461

[45] Date of Patent: Oct. 1, 1991

[54] SECURITY GATE OPERABLE WITH ONE HAND

[75] Inventor: Carl M. Stern, Lawrenceville, N.J.

[73] Assignee: Innova Development Corporation, Pennington, N.J.

[21] Appl. No.: 492,968

[22] Filed: Mar. 13, 1990

Related U.S. Application Data

[62] Division of Ser. No. 326,178, Mar. 17, 1989, abandoned, which is a division of Ser. No. 100,336, Sep. 23, 1987, abandoned.

[51] Int. Cl.[5] ..... E06B 3/12

[52] U.S. Cl. ..... 160/224; 160/216; 292/150

[58] Field of Search ..... 160/224, 225, 117, 215, 160/216; 49/55, 463; 292/336.3, 150, 359, DIG. 37; 74/483 PB

[56] References Cited

U.S. PATENT DOCUMENTS

| | | | |
|---|---|---|---|
| 903,554 | 11/1908 | Haben . | |
| 1,120,361 | 12/1914 | Bauer | 160/224 |
| 1,662,167 | 3/1928 | Rexinger . | |
| 1,683,204 | 9/1928 | Mills . | |
| 2,559,066 | 7/1951 | Diefenbronn . | |
| 2,581,857 | 1/1952 | Harrison . | |
| 2,756,469 | 7/1956 | Cattermole et al. . | |
| 2,851,746 | 9/1958 | McPhaden . | |
| 2,896,277 | 7/1959 | Halligan . | |
| 2,928,146 | 3/1960 | Kuniholm . | |
| 3,000,063 | 9/1961 | Hoog . | |
| 3,163,205 | 12/1964 | Gottlieb . | |
| 3,216,482 | 11/1965 | Lindholm . | |
| 3,885,616 | 5/1975 | Berkowitz . | |
| 4,465,262 | 8/1984 | Itri et al. . | |
| 4,492,263 | 1/1985 | Gebhard . | |
| 4,607,455 | 8/1986 | Bluem et al. | 49/55 |

FOREIGN PATENT DOCUMENTS

| | | |
|---|---|---|
| 992830 | 6/1949 | France . |
| 2543209 | 9/1984 | France . |
| 2187495 | 9/1987 | United Kingdom . |

*Primary Examiner*—Blair M. Johnson
*Attorney, Agent, or Firm*—Franklyn Schoenberg

[57] ABSTRACT

A security gate includes an installation and release mechanism that is operable with one hand. The gate comprises two panels which are extendible with respect to each other and lockable in the extended position. This makes it possible for the gate to expand across a wide variety of door openings. A handle located centrally on the top of the gate is connected by a pair of cranks and a pull rod to a pair of plungers which contact one side of the door frame. Spring bias on the plungers normally force the plungers into contact with the door frame. Slots in the upper and lower plunger links permit the plungers to accommodate irregular door frames. The handle is employed to withdraw the plungers from contact with the door frames and, conversely, the absence of handle pressure causes the gate to position itself solidly against the vertical door jamb. The handle is also employed by the operator to carry and position the gate in the doorway, allowing one-handed operation. A thumb operable handle interlock system prevents the handle from being accidentally manipulated unless one of two release interlock buttons is depressed by the thumb of the user. Also, the two extended panels are held in position by a second safety interlock which prevents a pair of extension adjustment knobs from rotating unless the extension interlock is released.

2 Claims, 17 Drawing Sheets

SECURITY GATE OPERABLE WITH ONE HAND

CROSS-REFERENCE TO RELATED APPLICATION

This application is a division of application Ser. No. 326,178, filed on March 17, 1989, which is a division of application Ser. No. 100,336, filed Sept. 23, 1987, both now abandoned.

BACKGROUND OF THE INVENTION

1. Field of the Invention

The invention relates to a security gate which can be positioned and removed with one hand.

2. Description of Related Art

There are numerous security gates on the market and known in the prior art. However, almost all share problems in the general areas of ease of use, human factors, and/or ease of installation and removal.

One of the most difficult aspects of prior art security gates is that more than one hand is usually required to install or remove the gate. Only a few security gates are operable with one hand, however, their mechanisms and structures are very different from the present invention. See, for example, U.S. Pat. No. 2,581,857. In contrast, according to the gate of the present invention, a handle located at the top of the gate is used both to carry the gate and to operate the release mechanism, thereby allowing true one-handed operation. French Patent No. 992,830 describes a door and window locking mechanism in which a single handle causes a pair of spring-loaded bolts to withdraw from or contact the door or window frame. The mechanism otherwise described in French Patent No. 992,830 appears to be irrelevant in the context of a security gate.

With most prior art gates the main adjustment is lost every time the gate is removed. Therefore the gate must be painstakingly readjusted every time it is used, leading to a greater likelihood of improper installation. With some other gates, the adjustment is held when the gate is removed. However, changing doorways means carefully readjusting the gate for each doorway. In contrast, with the gate of the present invention, the coarse adjustment is made easily and can be remembered, either by mentally noting the indicator position or the user may mark the indicator position with a suitable writing instrument. Once the present invention is adjusted for a given doorway, no further adjustment is needed to repeat installing and removing the gate from the same doorway.

Many security gates make no provision to adequately prevent a child from operating the mechanism which releases the gate. In other cases, the only obstacle to a child's removing the prior art gate is that high force is required to operate the mechanism. However, the high force prior art approach has clear disadvantages to the user, especially when the gate is installed or removed by an adult with below average strength as may be the case with an elderly individual. In contrast, the present invention provides two interlocks which prevent a child from releasing the gate. The two interlocks employed by the present invention require two distinct, separate operations that are generally difficult for a child to coordinate.

With regard to many prior art security gates, the loading of the gate in the doorway, and therefore its security in the doorway, is very sensitive to the specific manner in which the gate is adjusted during installation.

The installation adjustment is often left to the judgment of the user with very little guidance. Small changes in adjustment to such prior art gates produce large changes in loading. As a consequence, it is quite easy for the user to install a prior art gate either too loose, so that it is not secure, or too tight, which risks damaging either the gate itself or the doorway, wall, or whatever it is installed in. For example, some gates require pushing a lever into a given notch. Missing the correct prior art notch by one notch in one direction makes the gate too tight and missing the prior art notch by one in the other direction leaves the gate too loose. Additionally, it is often difficult to determine the correct notch in the first place with many prior art gates, thereby requiring a fussy trial-and-error procedure. This problem is overcome by the device of the present invention by incorporating a compressed spring which has a relatively low spring rate. This unique feature permits additional changes in the compression of the spring to require a small relative increase in the total overall force applied to the plungers. The result is that the present invention is much easier to adjust for a given doorway.

In addition to the prior art described in detail above, the following U.S. Pat. Nos. may also be relevant to the general state of the art: 903,564; 2,559,066; 2,756,469; 2,851,746; 2,896,277; 2,928,146; 3,000,063; 3,163,205; 3,216,482; 3,885,616; 4,465,262; 4,492,263 and 4,607,455.

SUMMARY OF THE INVENTION

Briefly described the invention comprises a security gate of the type employed to prevent children or animals from entering dangerous areas such as stairways. The gate itself consists of a front and rear panel which are extendible with respect to each other and lockable in a variety of extended positions. The gate also includes a single handle which operates a pair of spring-loaded plungers which in turn make contact with the door jamb. The handle is connected by a pair of cranks and a pull rod to the plungers. Spring bias on the plungers normally force the plungers into contact with the door frame. Pulling up on the handle causes the plungers to withdraw from contact with the door frame. The central location of the handle at the top of the gate also allows the operator to carry and position the gate in the doorway, allowing one-handed operation.

A handle safety interlock prevents the handle from being accidentally released. Once the gate is in position it is virtually impossible to remove it by simple upward pressure on the handle. One of two handle release interlock buttons must be depressed prior to pulling up on the handle. To provide further safety, the handle release interlock buttons must continue to be depressed while pulling upward on the handle.

A second interlock is incorporated into the gate to prevent the release of the front and rear panels with respect to each other once they have been set in an extended position. One panel carries a rotatable extension adjustment knob which includes a cammed surface which impinges upon a ring having teeth therein. Rotation of the knob causes the teeth to move into engagement with teeth on a rack carried by the other panel. The knob includes a flat extension which if rotated far enough engages a resilient boss incorporated in the first panel. The teeth on the ring and the teeth on the rack cannot disengage unless the boss is depressed thereby releasing the knob extension.

These and other features of the invention will be more fully understood by reference to the following drawings.

DETAILED DESCRIPTION OF THE PREFERRED EMBODIMENT

During the course of this description like numbers will be used to identify like elements according to the different views which illustrate the invention.

Figure 1:
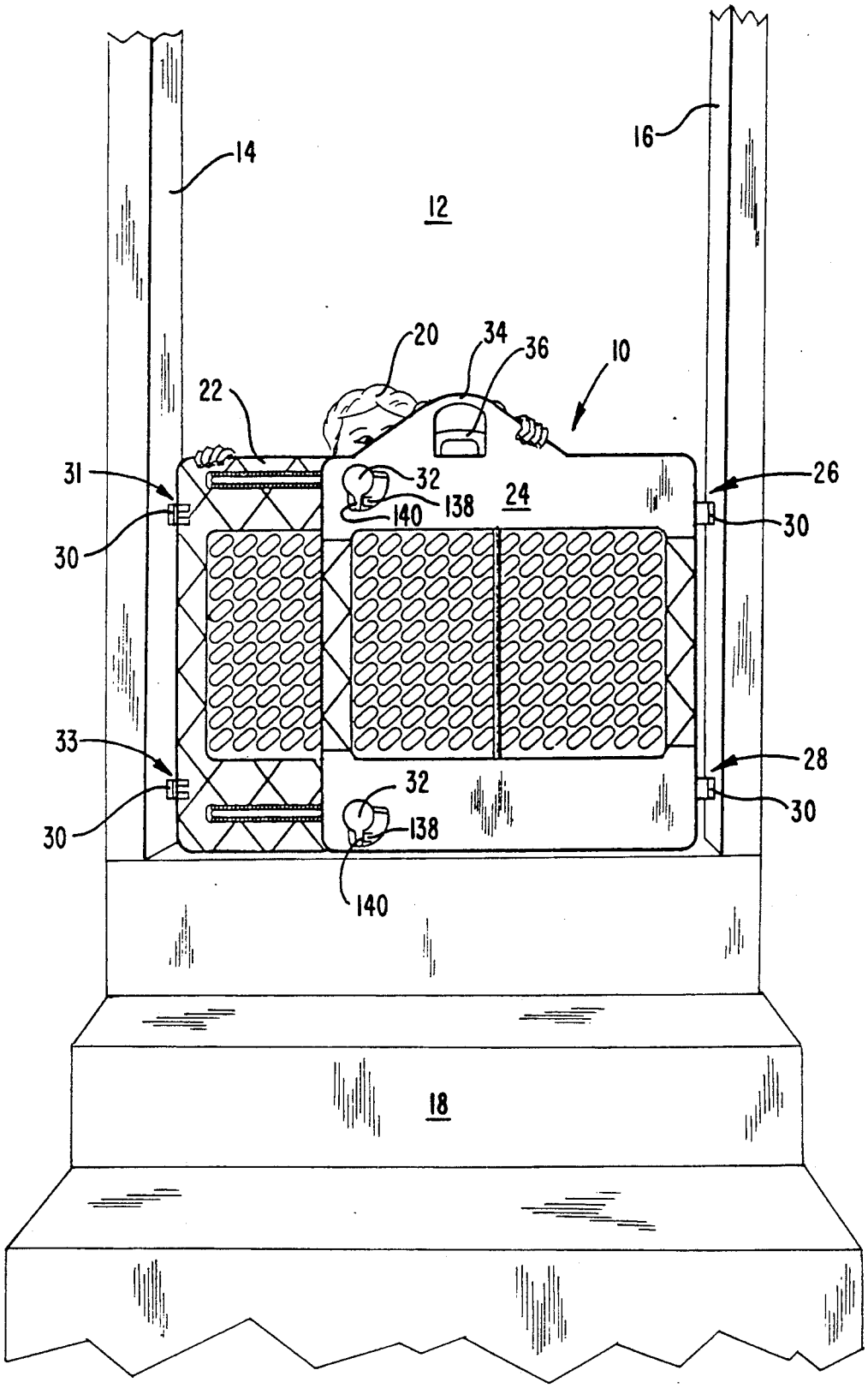
FIG. 1 is a rear elevational view showing the preferred embodiment of the gate invention in position in a door frame.
Figure 2B:
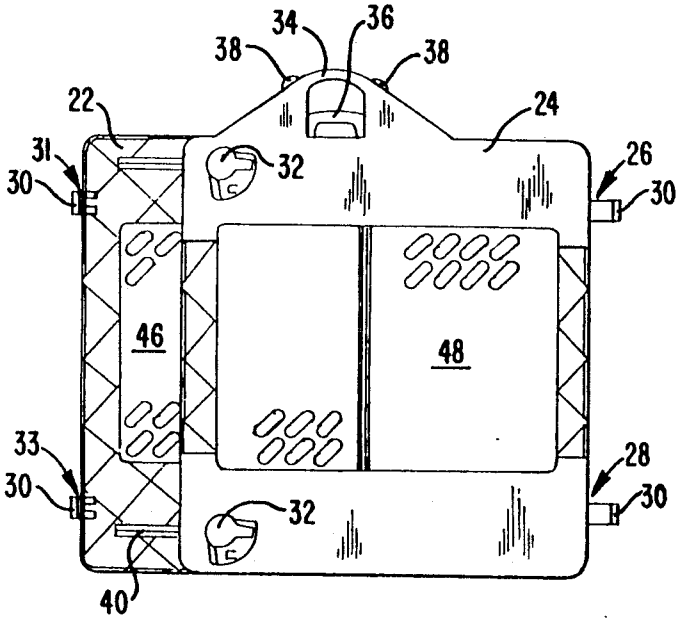
FIG. 2B is a rear elevational view of the gate illustrated in FIG. 2A.
Figure 2D:
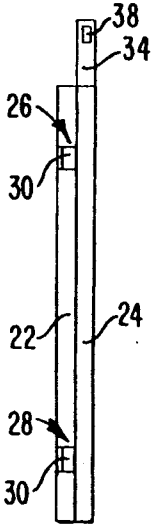
FIG. 2D is a right side elevational view of the gate illustrated in FIG. 2A.
Figure 2E:
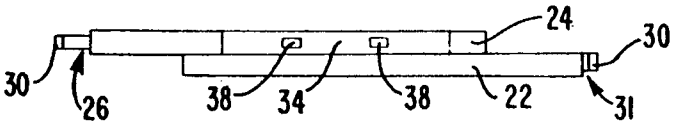
FIG. 2E is a top view of the gate illustrated in FIG. 2A.
Figure 2A:
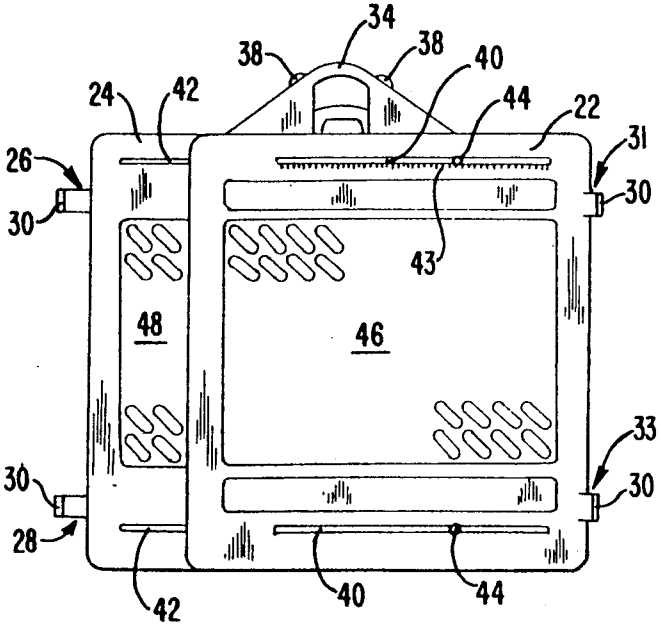
FIG. 2A is a front elevational view of the assembled gate.
Figure 2F:
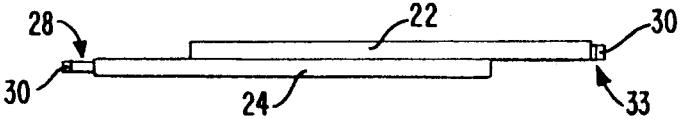
FIG. 2F is a bottom view of the gate illustrated in FIG. 2A.
Figure 2C:
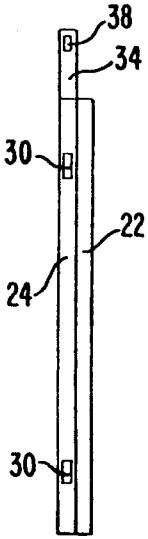
FIG. 2C is a left side elevational view of the gate illustrated in FIG. 2A.

The preferred embodiment of the security gate 10 is illustrated in FIG. 1. Security gate 10 is illustrated in the context of a doorway 12 having a left door jamb 14 and a right door jamb 16 as seen from the perspective of stairs 18. A child 20 is shown behind gate 10 in the manner in which children often are found at or near the top of stairs 18.

The larger components of gate 10 include a front panel 22 which normally faces a user or child 20 and a rear panel 24. Most of the components of the invention are carried in and by the rear panel 24. The gate 10 is held in position by resilient plunger assemblies 26 and 28 and stationary feet 31 and 33. Plungers 26 and 28 and feet 31 and 33 are each capped by resilient pressure pads 30. Plungers 26 and 28 are movable by squeezing upward on handle 36 which is housed within an arched frame 34 molded into panel 24. The central location of handle 36 at the top of the gate, as illustrated in FIG. 1, plays a significant role in the invention. Said location allows handle 36 to be used for carrying and positioning the gate in a doorway as well as to release the plunger mechanism. The handle 36 is located substantially above the center of gravity of the gate 10 when the gate 10 is vertical so that the gate 10 will be balanced when removed and carried by the user. A pair of extension adjustment knobs 32 are employed to adjust the coarse extension of the gate 10 by controlling the positioned relationship of panel 22 with respect to panel 24. Extension adjustment knob 32 includes a tab or extension 140 for engaging an interlock boss 138 carried by panel 24 in a manner described subsequently with regard to FIG. 5.

FIGS. 2A–2F illustrate the gate 10 in the six standard orthogonal views. A pair of handle release interlock buttons 38 are shown in position on either side of handle 36. The amount of coarse extension adjustment of gate 10 is readable from the position of the upper of the two indicator buttons 44 which travels along the length of upper slot 40 which includes marking or notch indicia 43. For weight and aesthetic reasons, panel 22 includes lattice apertures 46 and panel 24 includes similar lattice apertures 48.

Figure 3A:
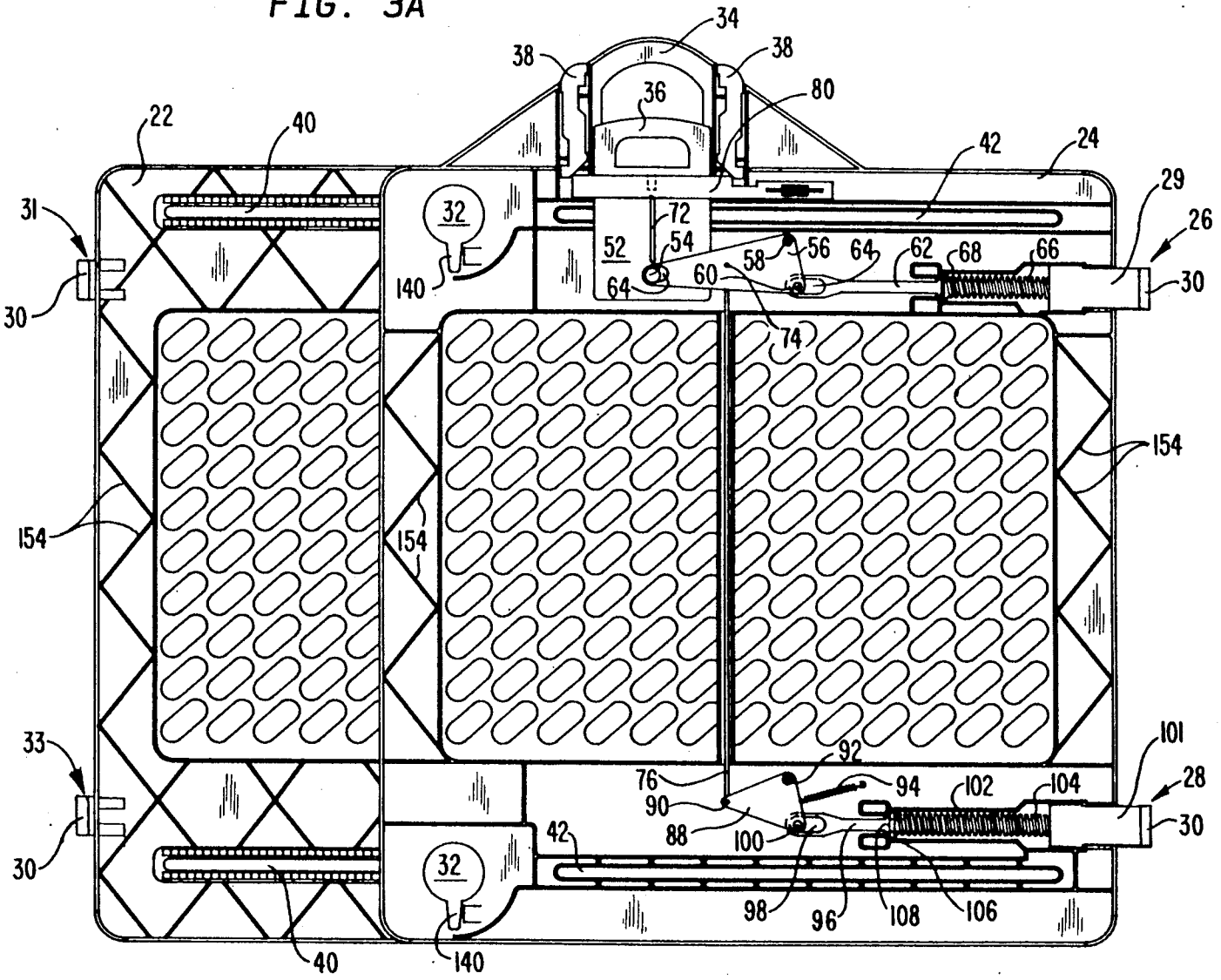
FIG. 3A is a cross-sectional elevational view of the gate as seen from the rear.
Figure 4A:
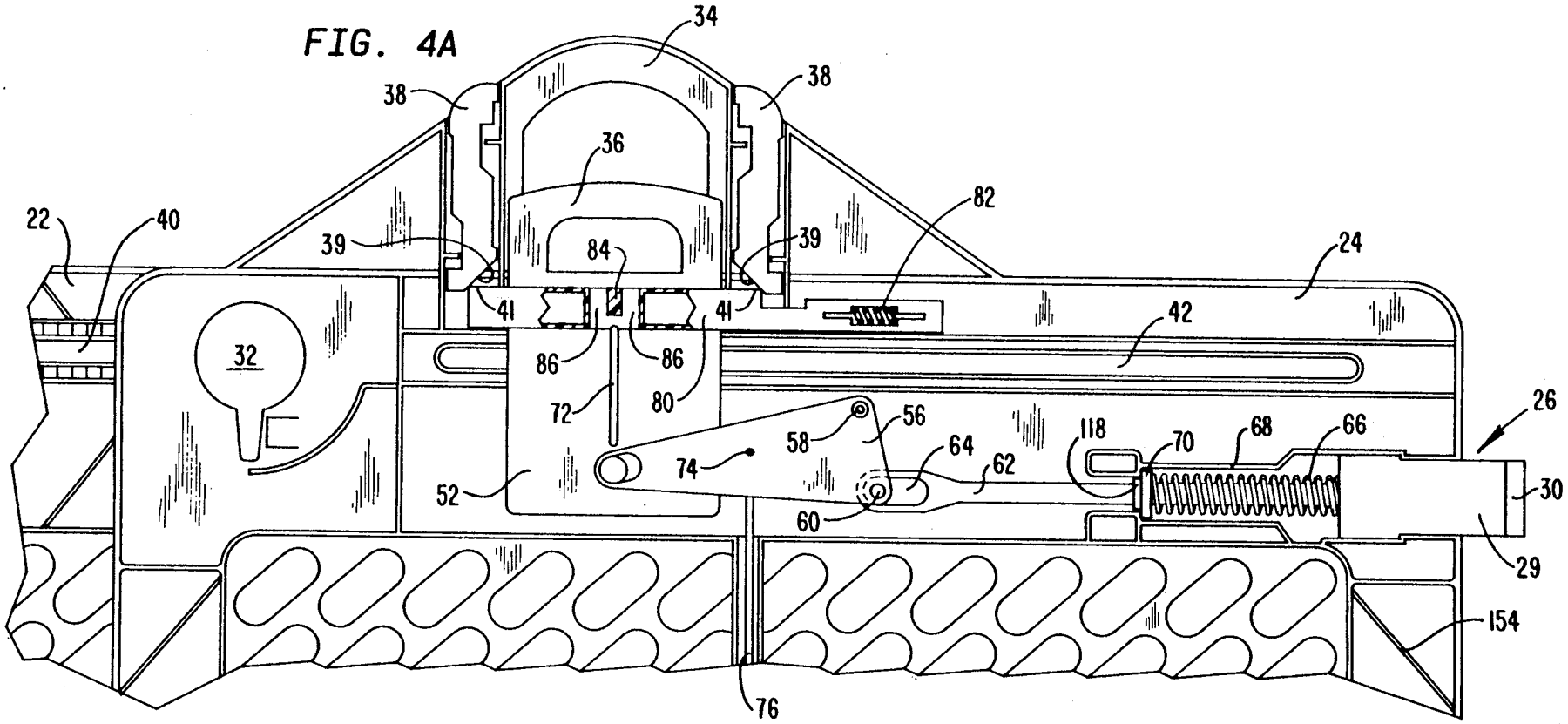
FIG. 4A is a detailed view of the handle, handle safety interlock mechanism, and the upper plunger prior to manipulation.

The general overall details of the assembled gate 10 are shown in FIG. 3A. In FIG. 3A the movable plunger assemblies 26 and 28 are not shown engaged with a door jamb. The movement of plungers 26 and 28 is controlled by a system of links, cranks and springs all connected to pull handle 36. Handle 36 is connected by an extension 52 to a pin 54 that rides in a slot in upper bell crank 56. Crank 56 pivots around pin 58 molded into panel 24. Crank 56 also carries a pin 60 engagable in slot 64 of upper plunger link 62. Pull rod 76 is bent at 90° at either end, and the upper end of pull rod 76 engages hole 74 molded in upper bell crank 56, and the lower end of pull rod 76 engages hole 90 molded in lower bell crank 88. Upper link 62 is partially carried inside a housing 68 molded into panel 24. A low compression rate pressure spring 66 is also located within housing 68 and normally biases the upper plunger assembly 26 and therefore pressure pad 30 outwardly. Pressure pad 30 is carried by a pad holder 29 which is attached by a conventional rivet to upper link 62. As illustrated in FIG. 4A, pressure spring 66 is held in place at one end by pad holder 29 and at the other end by link collar 70 which surrounds the upper link 62 and seats against an upper link shoulder 118 which is integral with the upper link 62.

The structure and operation of the lower plunger assembly 28 is similar to the structure and function of the upper plunger assembly 26. Upward movement imparted to handle 36 is transmitted to extension 52, pin 54, crank 56, and pull rod 76 to the lower bell crank 88. Lower crank 88 rotates around a second pivot pin 92 molded into panel 24. A return spring 94 is connected between lower crank 88 and panel 24 and tends to return handle 36 to its downward position when the handle is released. Pin 100 carried by lower crank 88 loosely engages slot 98 in the lower plunger link 96. Lower link 96 also fits within a housing 102 molded into the structure of panel 24. Pressure pad 30 is carried by a pad receiver or guide 101 similar to pad holder 29 in the upper link assembly 26 and attached by a conventional rivet to the lower link 96. Another low compression rate spring 104 having a somewhat lighter initial load than the upper spring 66 is also captured within housing 102. One end of low compression rate spring 102 bears against the pad holder 101 and the other end presses against lower link collar 106 which normally abutts lower link shoulder 108. The natural tendency of upper spring 66 and lower spring 104 is to bias plunger assemblies 26 and 28 respectively outward. Also visible in FIG. 3A are a plurality of ribs 154 molded into panels 22 and 24 and intended to impart structural rigidity to the overall gate assembly.

Figure 3B:
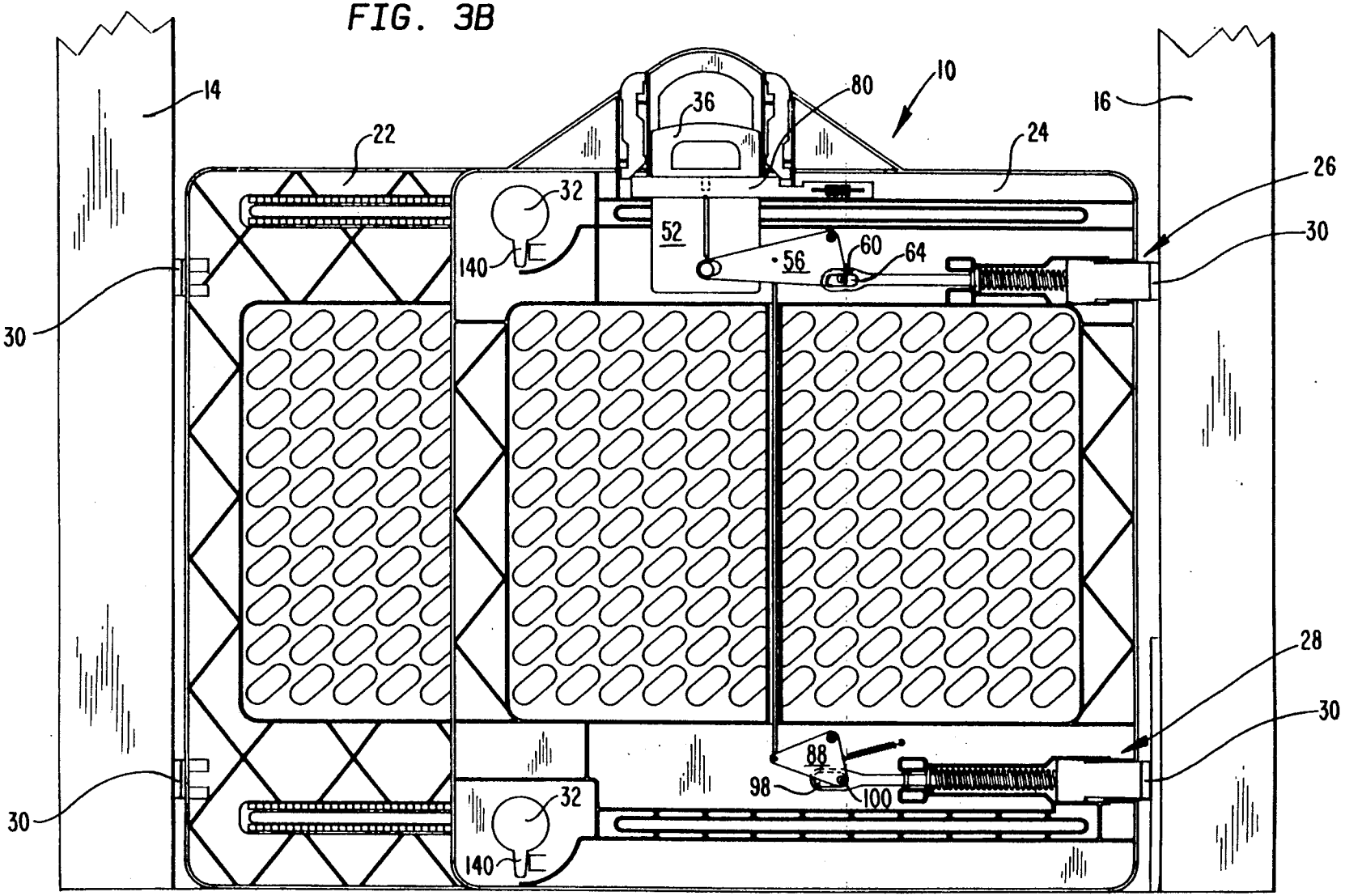
FIG. 3B is a cross-sectional view of the gate illustrated in FIG. 3A as shown in the context of a doorway having an uneven vertical jamb.

As shown in FIG. 3B, slots 64 and 98 play a significant role in the invention. FIG. 3B illustrates a situation in which the right hand door jamb 16 has an irregular surface. Lower plunger assembly 28 is shown further withdrawn than upper plunger assembly 26. Accordingly, pin 100 of lower crank 88 is further forward in slot 98 with respect to its pressure pad 30 than is pin 60 of upper crank 56 which rides in slot 64 of the upper plunger assembly 26. Slots 64 and 98 permit the handle 36 to withdraw both plunger assembly 26 and 28 the same distance, however when handle 36 is released plungers 26 and 28 will seek their own levels only restricted by the length of slots 64 and 98. This feature is especially useful in older houses where the settling and/or aging of the structure may cause the door jambs 14 and 16 to assume irregular vertical attitudes.

Figure 3C:
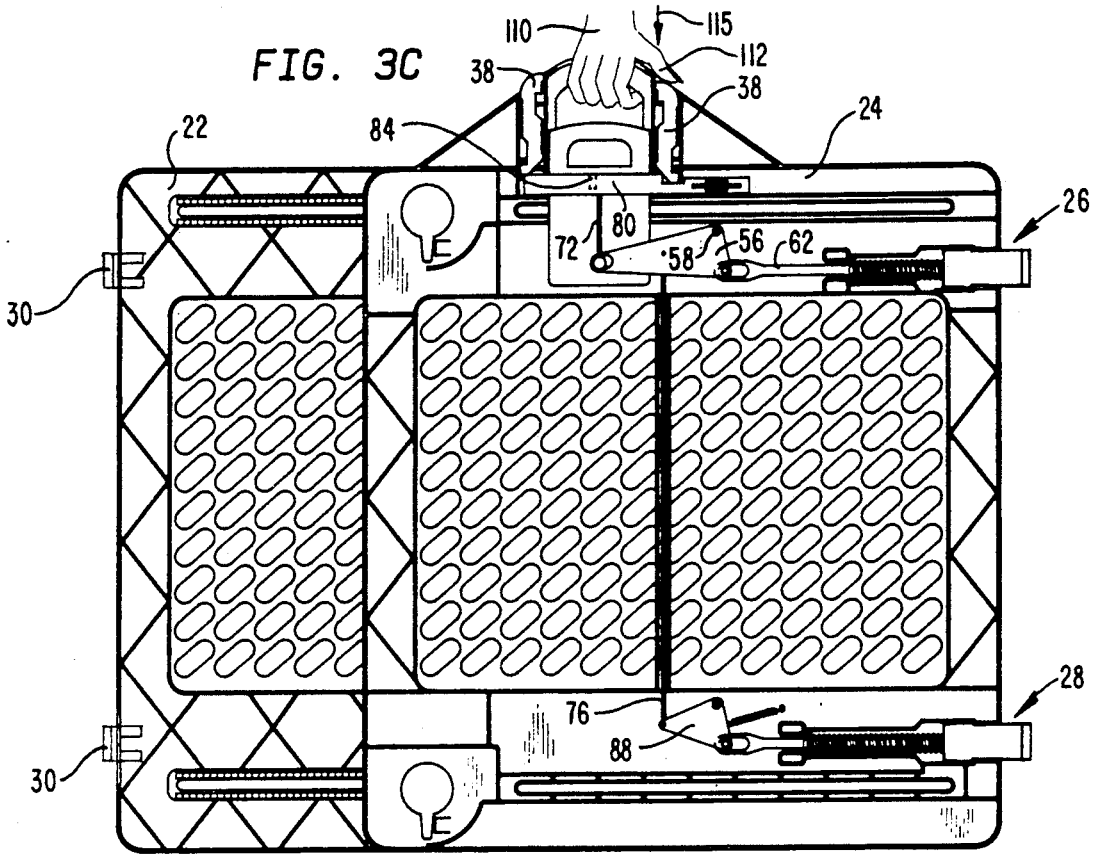
FIG. 3C is a cross-sectional view of the gate illustrated in FIG. 3A with the handle interlock button depressed.
Figure 3D:
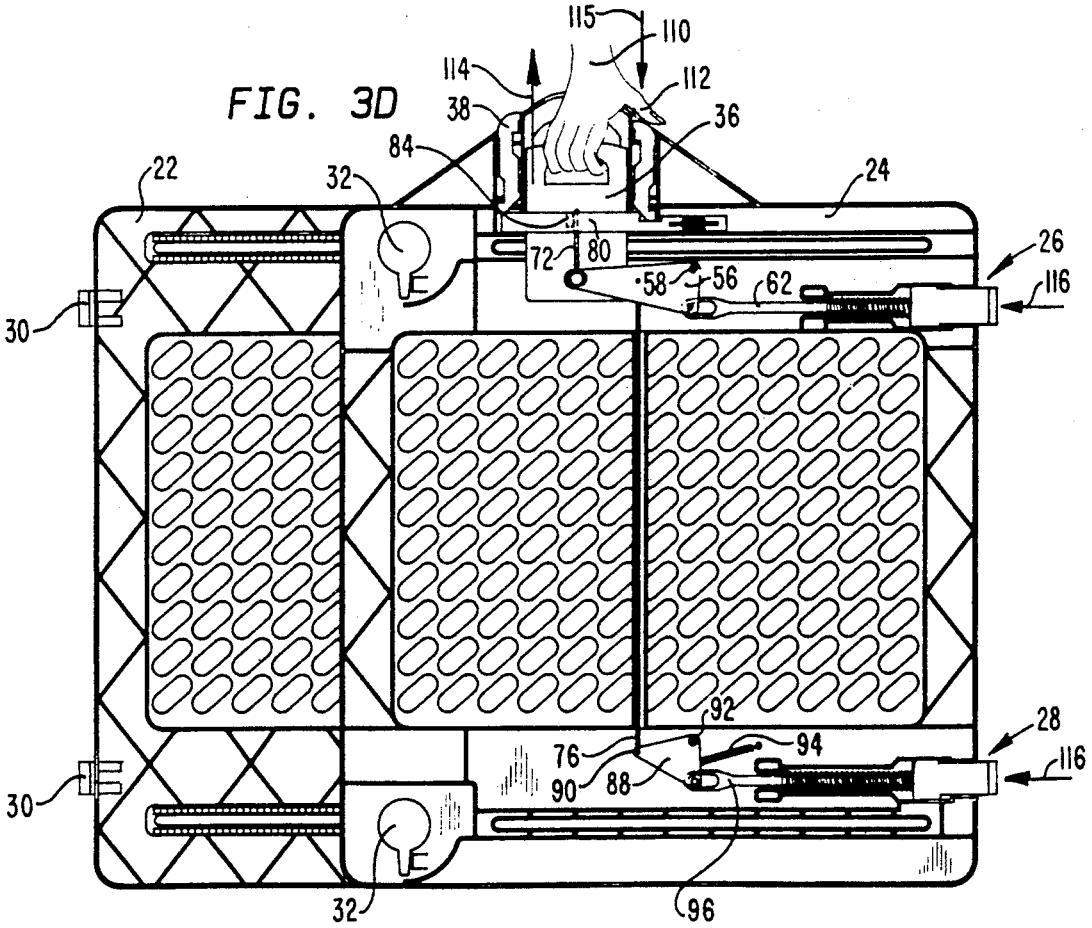
FIG. 3D is a cross-sectional view of the gate illustrated in FIG. 3C with the handle pulled upward, the handle safety interlock button depressed and the plungers withdrawn inward under the influence of the handle.

FIGS. 3C and 3D illustrate in overall detail the manner in which the handle 36 and handle interlock release buttons 38 cooperate with respect to both the upper plunger assembly 26 and the lower plunger assembly 28. The first step in releasing the security gate 10 is for the operator 110 to depress one of the two handle interlock release buttons 38 with the thumb 112 in the direction of arrow 115 as shown in FIGS. 3C and 3D. Thumb pressure on either release button 38 forces interlock shuttle or bar 80 to move either to the right or the left, horizontally. That action in turn allows the rib 72 carried by the lower handle extension 52 to move upwardly past interference detent pin 84 carried by the interlock bar 80. The upward movement 114 of handle 36 causes upper crank 56 to rotate about pin 58 thereby drawing upper plunger 26 inwardly in the direction of arrow 116 as shown in FIG. 3D. The rotation of crank 56 about pin 58 is also transmitted via pull rod 76 to lower crank 88. Rotation of lower crank 88 about pin 92 causes the lower plunger assembly 28 to withdraw in the direction of arrow 116.

Figure 4B:
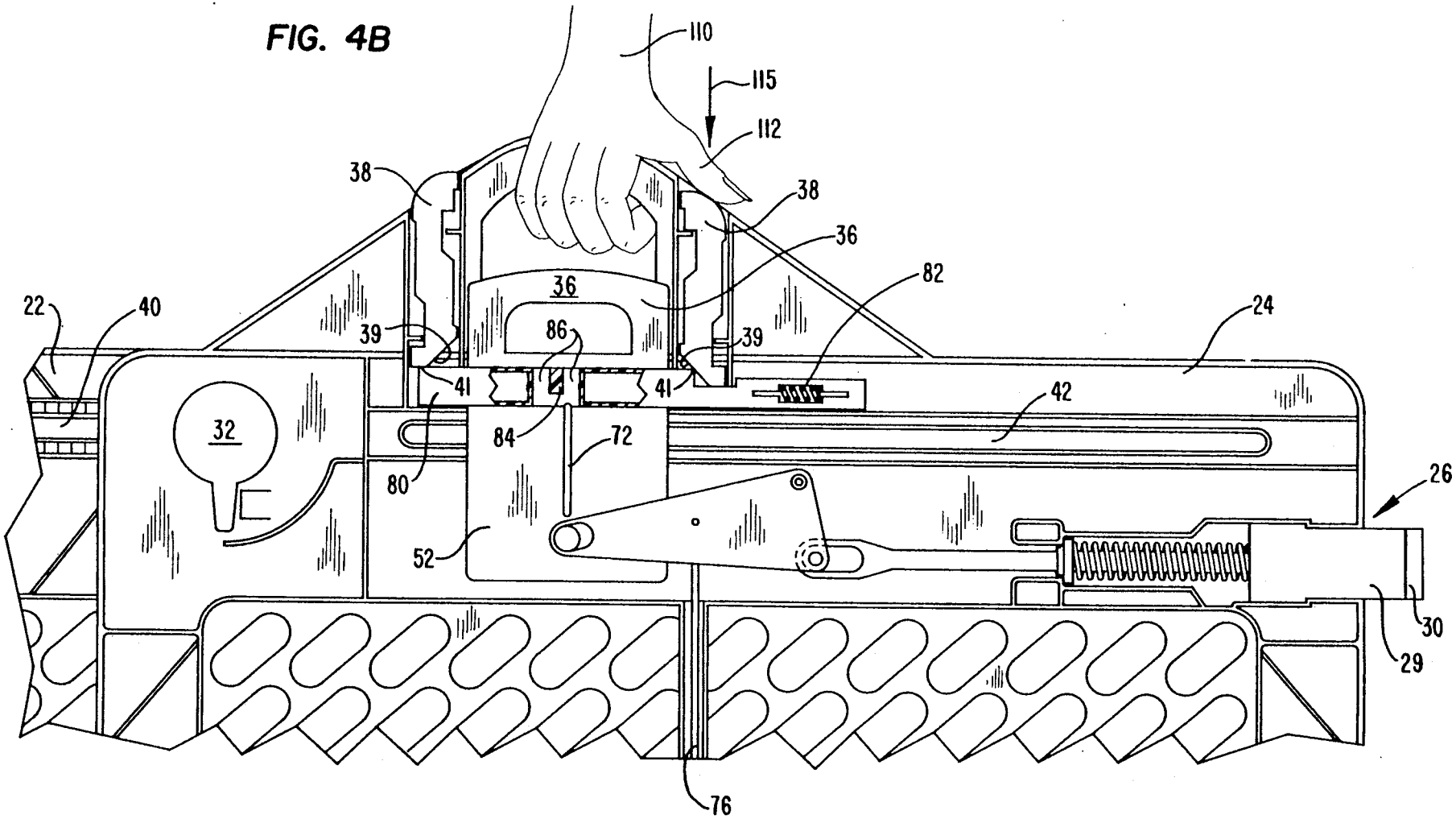
FIG. 4B is a detailed view of the handle safety interlock of FIG. 4A shown in the release position.
Figure 4C:
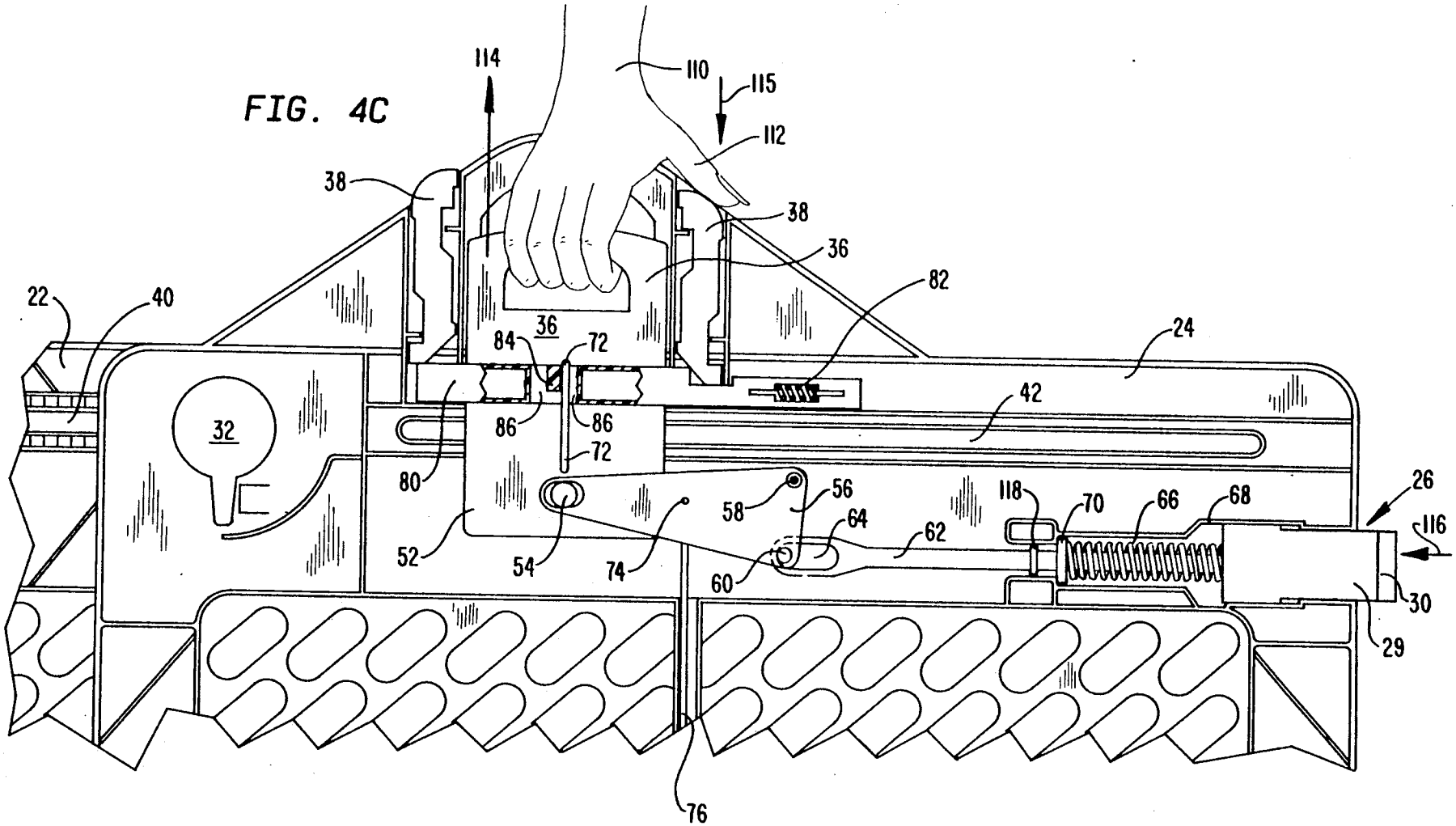
FIG. 4C illustrates the manipulation of the handle after the handle safety interlock mechanism has been released as shown in FIG. 4B.

Details of the operation of the handle release interlock system can be further understood by reference to FIGS. 4A–4C. FIG. 4A illustrates the mode in which the interlock prevents the handle 36 from being manipulated thereby preventing the actuation of plunger assembly 26 and 28. If handle 36 were moved upwardly the rib 72 carried by the handle extension 52 would come into contact with interference pin 84 molded into safety interlock bar 80. Interlock bar 80 is normally returned to a centered, interfering position as shown in FIG. 4A by interlock spring 82 which is kept in a compressed state and housed within interlock bar 80. Interference pin 84 is surrounded by a pair of identical side passageways 86 which can accommodate the passage of rib 72 if the interlock bar 80 was sufficiently displaced horizontally either right or left, by either release button 38.

FIG. 4B illustrates the step necessary to release the handle interlock system. The user 110 places his or her thumb 112 on either safety release buttons 38 and pushes downwardly thereon in the direction of arrow 115. Each release button 38 includes a slanted lower surface 39 which normally contacts an edge or corner 41 carried on the movable interlock bar 80. Depression of release button 38 shown on the right in FIG. 4B causes the edge 41 of the interlock bar 80 to travel horizontally leftward under the camming action of inclined surface 39. Conversely, if the user 110 places thumb pressure on the other release button 38, shown on the left in FIG. 4B, the interlock bar slider 80 will move rightwardly under the camming influence of inclined surface 39 against corner 41. Rightward or leftward horizontal movement of interlock bar 80 will cause the rib 72 to become aligned directly under either passageway 86 out of the way of interference pin 84.

Continued thumb pressure in the direction of arrow 115 will keep the rib 72 in alignment with one of the two passageways 86. It is then possible for the user 110 to curl his or her fingers around handle 36 and pull upwardly in the direction of arrow 114 as shown in FIG. 4C. This causes rib 72 to enter either passageway 86 bypassing interference pin 84. The upward handle motion is imparted to crank 56 which withdraws the plunger assembly 26 in the direction of arrow 116 in the manner previously described. It is necessary to keep either release button 38 depressed until after rib 76 has passed beyond interference pin 84 and into either passageway 86. It is desirable to have a handle interlock safety system which requires continuous initial pressure on release button 38 so as to make it more difficult for a child to release the mechanism and remove the security gate.

The nature and structure of upper and lower plunger compression springs 66 and 104 is unique and significant to the present invention. Upper spring 66 is installed with a preferred pressure of approximately twenty-five pounds and a relatively low spring rate of five pounds per inch. The spring typically starts at an unloaded length of 9" and is compressed to about 4" at manufacture. While installing the gate, spring 66 is compressed an additional nominal ½", resulting in a nominal loading of about 27.5 lbs. However, if the security gate is misadjusted, so that the spring is compressed any amount within the total of about ¾" compression available, the force still varies very little from nominal. For example

| Additional Spring Compression | Nominal Loading Force |
|---|---|
| ⅛" | 25.6 lbs. (25 + 0.12 × 5 lbs./in.) |
| ½" | 27.5 lbs. (25 + 0.5 × 5 lbs./in.) |
| ¾" | 28.8 lbs. (25 + 0.75 × 5 lbs./in.) |

Therefore, assuming that the user has managed to adjust the security gate so that the plunger assemblies 26 and 28 are contacting the wall, even if not adjusted to the preferred ½" displacement, the loading force will vary by less than 10%.

The spring rate should be relatively low and preferably about 5 lb./in. Small variations would not make much difference. If, for example, the loading were 6 lb./in., then the change would still vary less than 10%. However, if the spring rate were increased to above 10 lb./in. then the variation would start to increase in the neighborhood of 14%. The preferred spring loading rate is in the range of 3 lbs. to 10 lbs. with a preferred single rate of 5 lbs./in.

In general the lower spring 104 is installed to a lighter load, preferably in the neighborhood of 16 lbs. The maximum loads of the springs 66 and 104 are limited by the strength and reach of the adult 110. In the foregoing example the amount of pressure that must be applied by the hand of the adult 110 is approximately 15 lbs. arrived at in the following manner.

| |
|---|
| 27.5 lbs. at top (installed nominal) |
| + 18.5 lbs. at bottom (installed nominal) |
| 46.0 lbs. total force on plungers |
| 46 ÷ 3 (mechanical advantage of cranks) = |
| 15 lbs. at the handle, not including friction. |

More spring force is allocated to the top plunger 26 than to the bottom plunger 28 because a child 20 is believed to be more likely to put more pressure against the top than against the bottom of the security gate. This, for example, might be the situation where the child is standing up and accidentally falls or pushes against the top of the gate.

Figure 5:
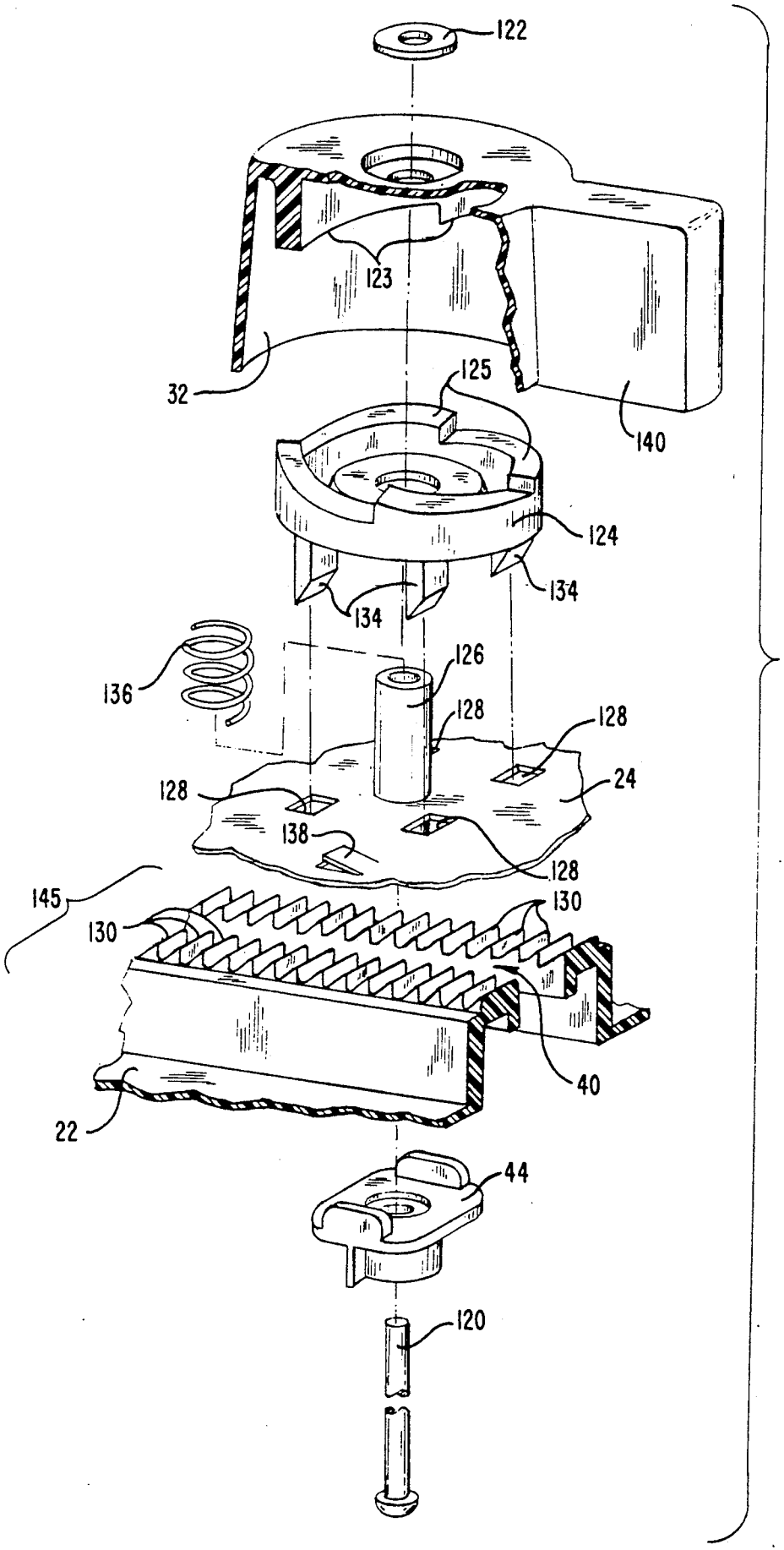
FIG. 5 is an exploded view of the gate extension knob and safety interlock mechanism.

FIGS. 5, 6A–6E and 7A and 7B illustrate the manner in which the security gate is extended and locked in its extended mode. FIG. 5 is an exploded view of the extension adjustment knob assembly with its associated safety interlock. Adjustment knob 32 includes a knob extension 140 and is mounted on post 126 molded into panel 24 and is held in position by rivet 120. The interior of knob 32 includes a plurality, preferably four, of inclined ramp sections 123 which are adapted to make sliding camming contact with the four ramp sections 125 carried by adjustment lock ring 124 which is also mounted on post 126. The other side of adjustment lock ring 124 carries a set of four teeth 134 which can move in and out of apertures 128 in panel 24. Spring 136 normally biases the slanted camming ramp surfaces 125 of adjustable lock ring 124 against the complementary camming ramp surfaces 123 of extension adjustment knob 32. A linear rack 145 including a plurality of teeth 130 is molded into panel 22 and is located on the opposite side of panel 24 from the knob 32 and adjustment lock ring 124. The teeth 130 of the linear rack 145 are located in two rows on opposite sides of upper or lower slot 40. Indicator 44 is located on the opposite side of slot 40 from the two rows of teeth 130 and is also held in place by rivet 120 the opposite end of which engages a washer 122 located at the top of adjustment knob 32. Movement of one panel 22 relative to the other panel 24 causes the indicator 44 to travel along slot 40 thereby giving a visual indication 43 of the amount of extension of the gate.

Figure 6A:
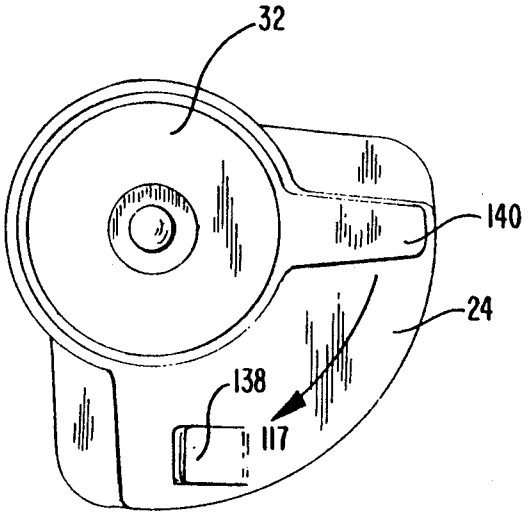
FIG. 6A is a front detail view of the gate extension knob of FIG. 5 shown in the unlocked position.
Figure 6B:
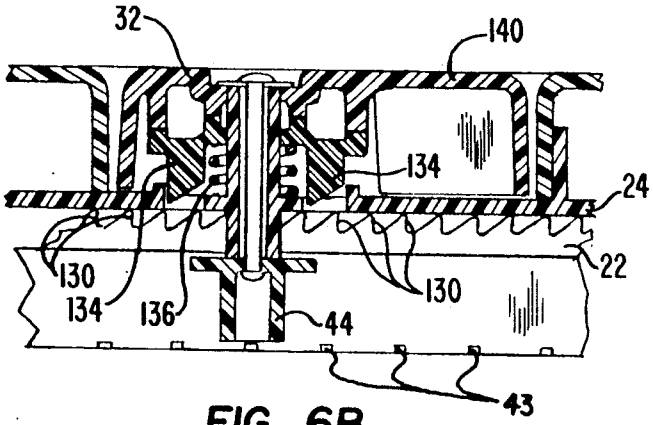
FIG. 6B is a cross-sectional detail view of the gate extension knob illustrated in FIG. 6A in the unlocked position.

Extension adjustment knob 32 is capable of 90 degrees of rotation from the 3 o'clock position to the 6 o'clock position and vice versa. FIGS. 6A and 6B illustrate the knob 32 in its unlocked position with the handle extension 140 located at the 3 o'clock position. In the unlocked position the teeth 134 are disengaged from the two rows of teeth 130 on the rack molded into panel 22. Accordingly, panels 22 and 24 are free to move horizontally with respect to each other.

Figure 6C:
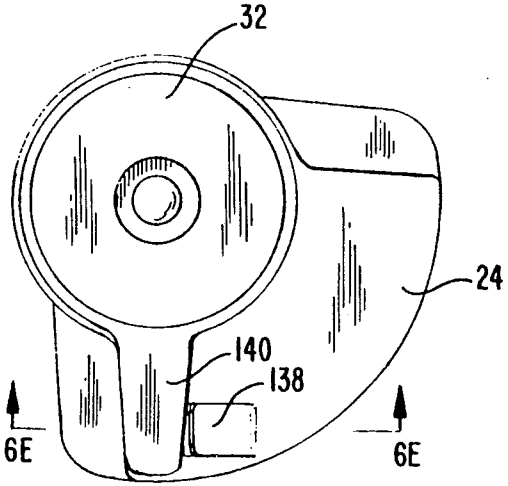
FIG. 6C is a front detail view of the gate extension knob shown in the locked position.
Figure 6D:
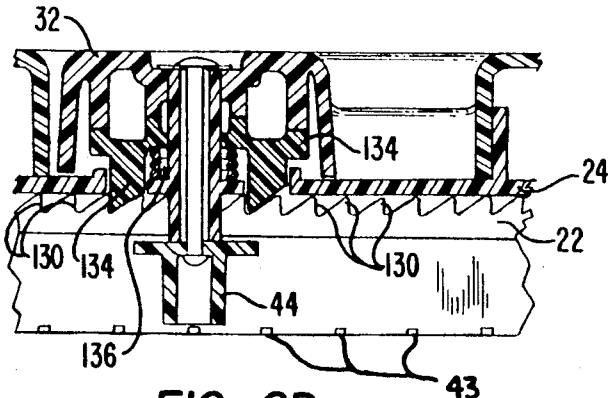
FIG. 6D is a cross-sectional detail view of the gate extension interlock knob illustrated in FIG. 6C in the locked position.
Figure 6E:
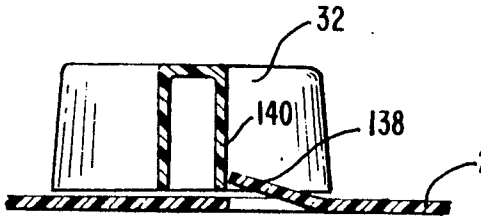
FIG. 6E is another cross-sectional detail view of the gate extension interlock knob illustrated in FIG. 6C showing the manner in which the knob extension is held in place by a boss.

Once the user 110 has set the coarse adjustment, he or she will rotate the knob 32 clockwise 90 degrees in direction of arrow 117 to the 6 o'clock position so that the handle extension 140 passes beyond interlock boss 138. This causes the handle extension 140 to be trapped behind the resilient boss 138 as shown in FIGS. 6C and 6E. The only way that the security gate can be unlocked is to depress resilient interlock boss 138 with a finger and then rotate the knob extension 140 counterclockwise to return it to its original 3 o'clock position. Rotation of knob 32 in clockwise direction 117 also causes the internal camming ramp surfaces 123 to move against the opposing camming ramp surfaces 125 of the locking ring 124. This motion causes the ring 124 to move downwardly thereby forcing teeth 134 deeper into apertures 128 and into engagement with the two rows of teeth 130 on the rack 145 carried by panel 22. FIG. 6D illustrates the situation in which the handle extension 140 has been rotated fully clockwise in the direction of arrow 117 to the 6 o'clock position and where the teeth 134 of the locking ring 124 are in full locking engagement with the two rows of teeth 130 on the rack 145 carried by panel 22. Indicator 44 shows at which notch or mark 43 position the panels 22 and 24 are immobilized with respect to slot 40. In the locked position a shown in FIG. 6C, 6D and 6E, it takes two distinctly different types of action to release the coarse adjustment knob 32. First a downward linear pressure has to be applied to resilient boss 138 to permit handle extension 140 to travel back counterclockwise from the 6 o'clock towards the 3 o'clock position. Second, rotational force has to be applied to adjustment knob 132 in the counterclockwise direction in order to disengage ring teeth 134 from rack teeth 130.

Figure 7A:
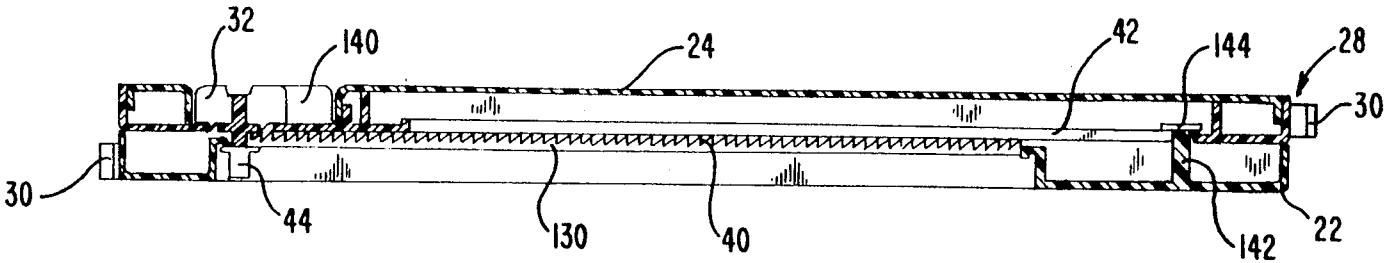
FIG. 7A is a top cross-sectional view of the gate as seen from the top with the panels in their most collapsed (i.e. unextended) state.
Figure 7B:
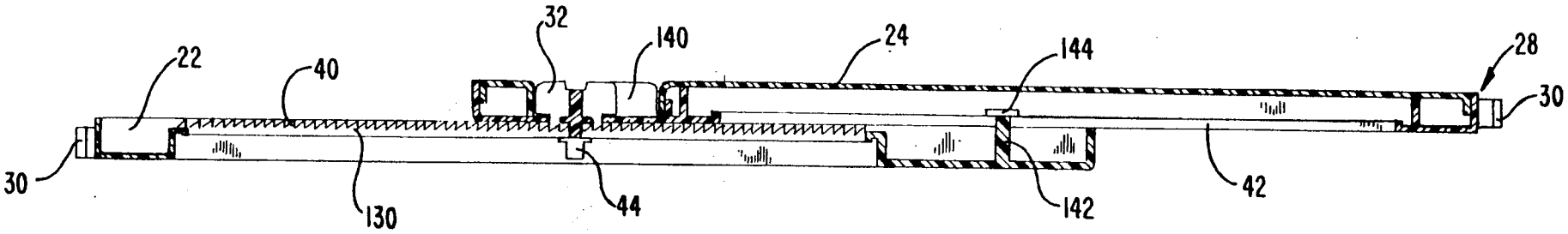
FIG. 7B is a top cross-sectional view of the gate shown in FIG. 7A with the gate partially extended.

FIGS. 7A and 7B show the security gate in a top cross-sectional profile in two different states of extension. In FIG. 7A the gate is shown in its relatively fully collapsed i.e. unextended state in which the panels 22 and 24 most face each other. According to the preferred embodiment of the invention the upper and lower coarse gate extension mechanism includes a pair of adjustment knobs 32 and a pair of adjustment slots 40. For balance, a second pair of pins and slots is provided in order to keep the loading symmetrical. This balance is provided by slider 144 which is mounted on post 142 molded into panel 22 and which travels in and along slot 42 of panel 24. The security gate illustrated in FIG. 7A is shown in the unlocked and most collapsed position as indicated by the position of knob extension 140. The security gate is extended by placing the adjustment knob 32 in the unlocked position shown in FIGS. 6A and 6B and then pulling the panels 22 and 24 apart so that they travel horizontally away from each other. FIG. 7B illustrates the security gate extended to an intermediate position. Note that the extension of panels 22 and 24 with respect to each other causes the indicator 44 to assume a different indicia position 43 along the teeth 130 of rack 145 and also causes the slider 144 to assume a different position with respect to slot 42.

Figure 8A:
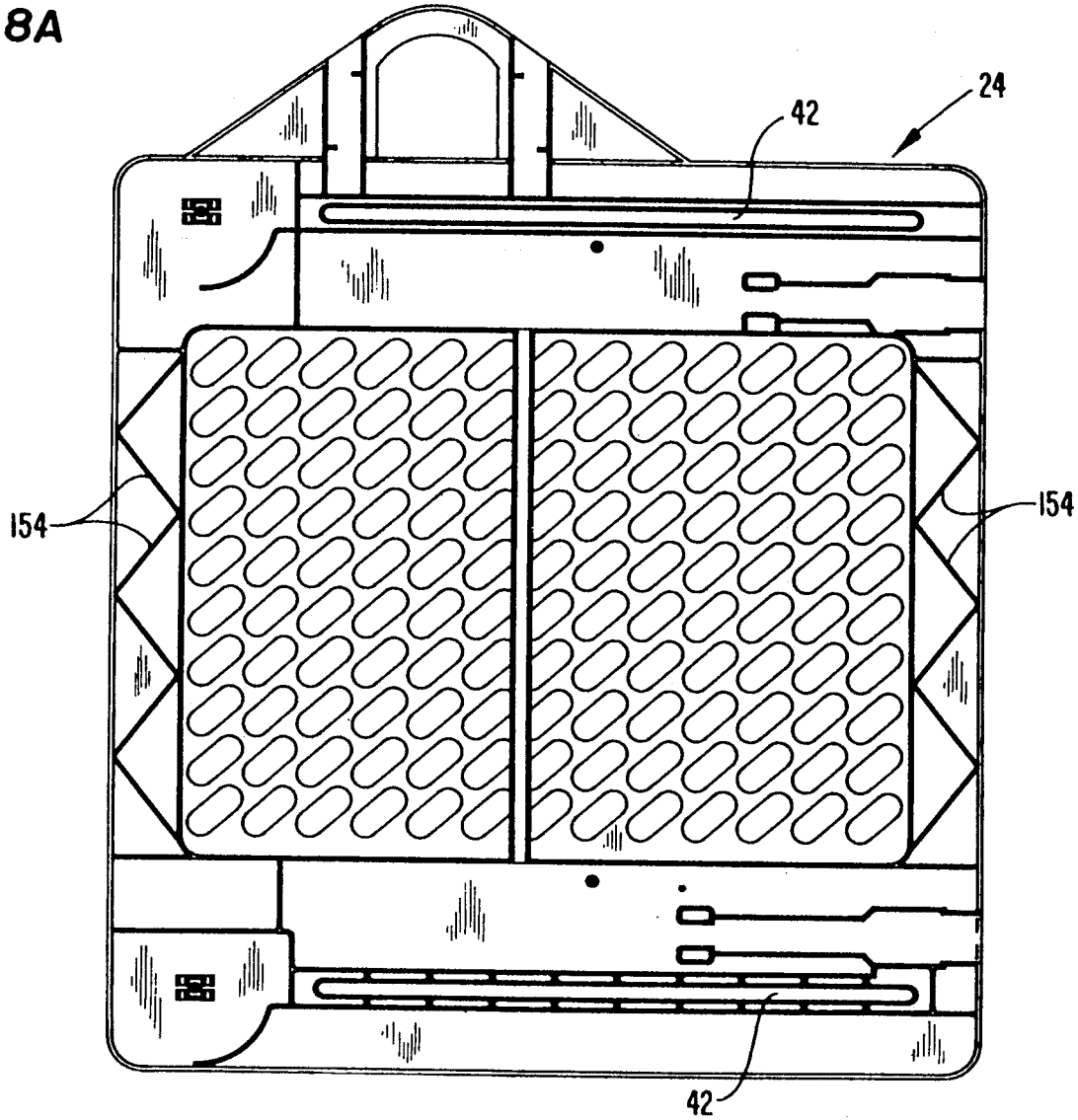
FIG. 8A is an inside elevational view of the rear panel illustrating the molded and raised portions thereof.
Figure 8B:
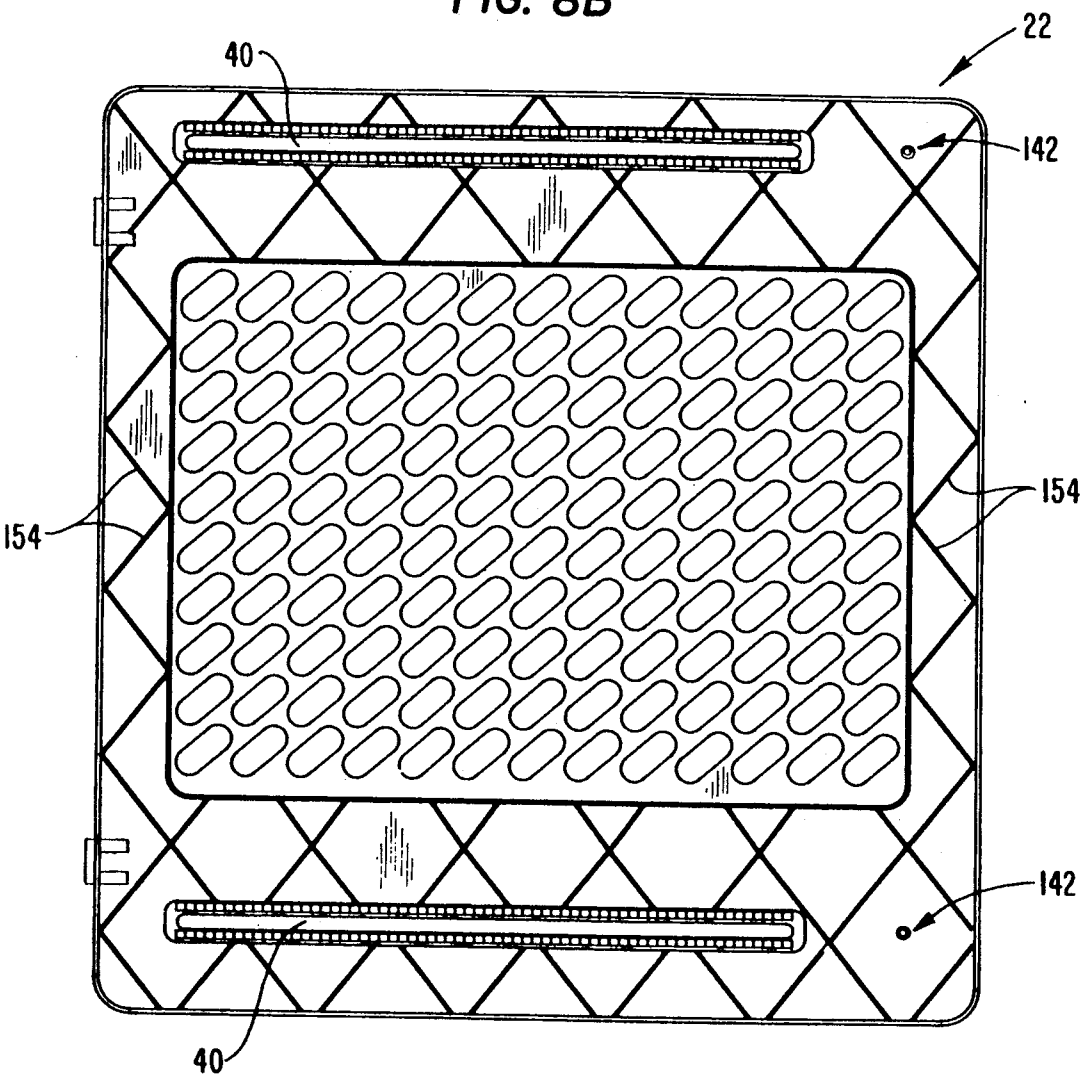
FIG. 8B is an inside elevational view of the front panel illustrating the molded and raised portions thereof.

FIG. 8A and 8B are provided to illustrate the inside views of panels 22 and 24. It is useful to note that most of the mechanical moving parts of the invention are housed within panel 24 which adds to increased ease of assembly.

FIG. 9A–9I illustrate the steps by which the user installs the gate in a doorway 12 and the manner in which the user subsequently removes the gate after use. First, in order to install the gate, the user 110 depresses the resilient boss 138 shown in FIG. 9A to release knob extension 140 thereby permitting it to be rotated counterclockwise from the locked 6 o'clock position in the direction of arrow 146 to the unlocked 3 o'clock position.

Figure 9A:
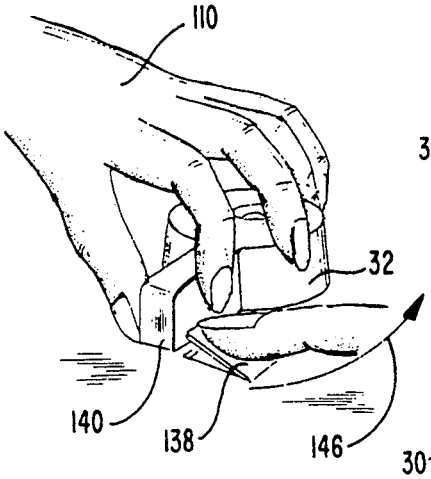
FIGS. 9A–9F illustrate the steps necessary to install the gate in a door frame.
Figure 9B:
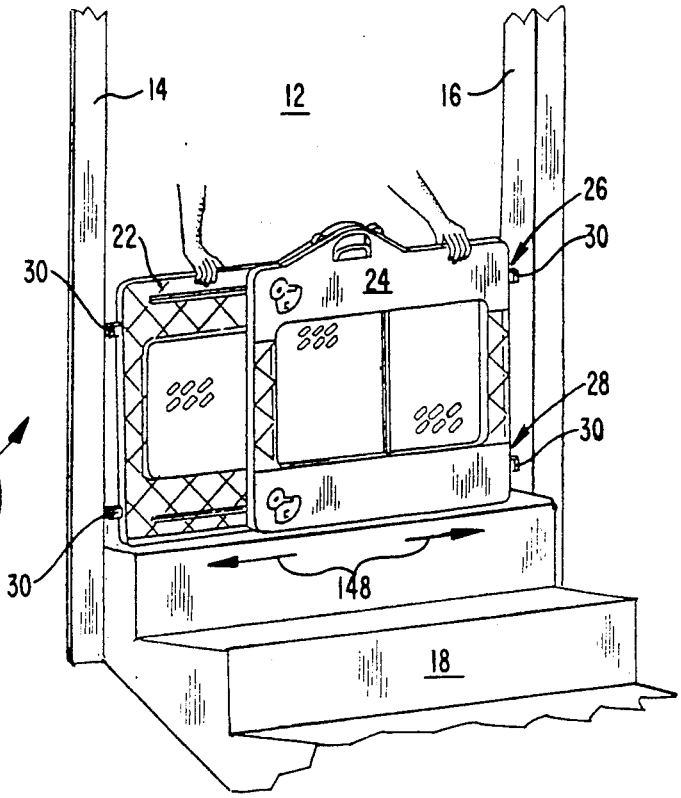

Second, the user 110 places the security gate in the doorway 12 and pulls panels 22 and 24 horizontally away from each other in the direction of arrows 148 until the pressure pads 30 just touch the door jambs 14 and 16 as shown in FIG. 9B. The user 110 then notes the position of the upper of the two indicators 44 when the pressure pads 30 are just touching the edges of the door frame.

Figure 9C:
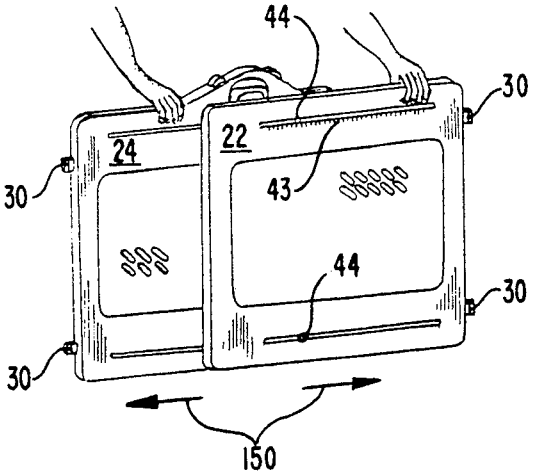

Third, as shown in FIG. 9C the user 110 expands the gate by two notches. According to the preferred embodiment of the invention two notches equals ½" because the indicia marks 43 relative to indicator 44 are located at ¼" intervals. Pulling the two panels 22 and 24 further apart by two notches causes the gate to expand in the direction of arrows 150 as shown in FIG. 9C.

Figure 9D:
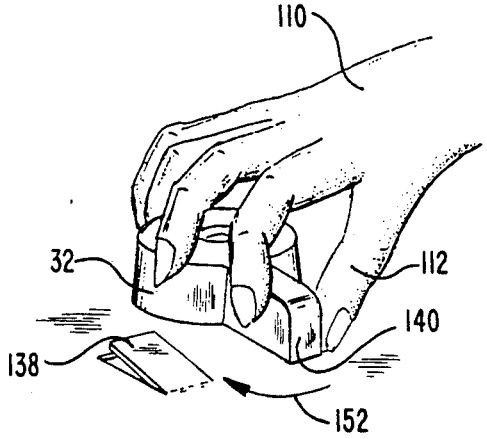

Fourth, as shown in FIG. 9D, the user 110 rotates knob 32 in the clockwise direction of arrow 152 from the unlocked 3 o'clock position to the locked 6 o'clock position so that the resilient boss 138 holds the knob extension 140 securely in the locked mode.

Figure 9E:
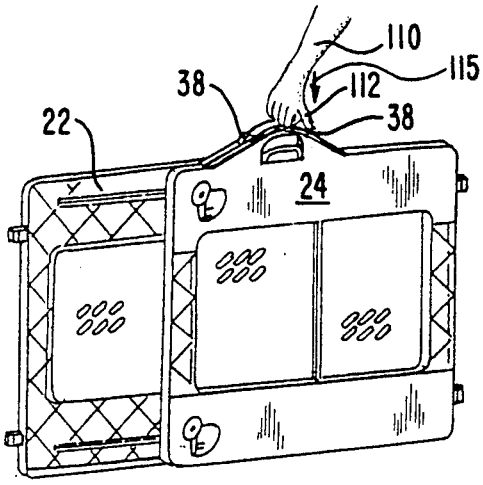

Fifth, as shown in FIG. 9E, the user 110 exerts thumb 112 pressure downwardly in the direction of arrow 115 against either handle interlock release button 38. The consequence of this action was previously described with reference to FIGS. 3C, 3D, 4B and 4C. Depression of either handle interlock release button 38 permits the user 110 to pull up on handle 36.

Figure 9F:
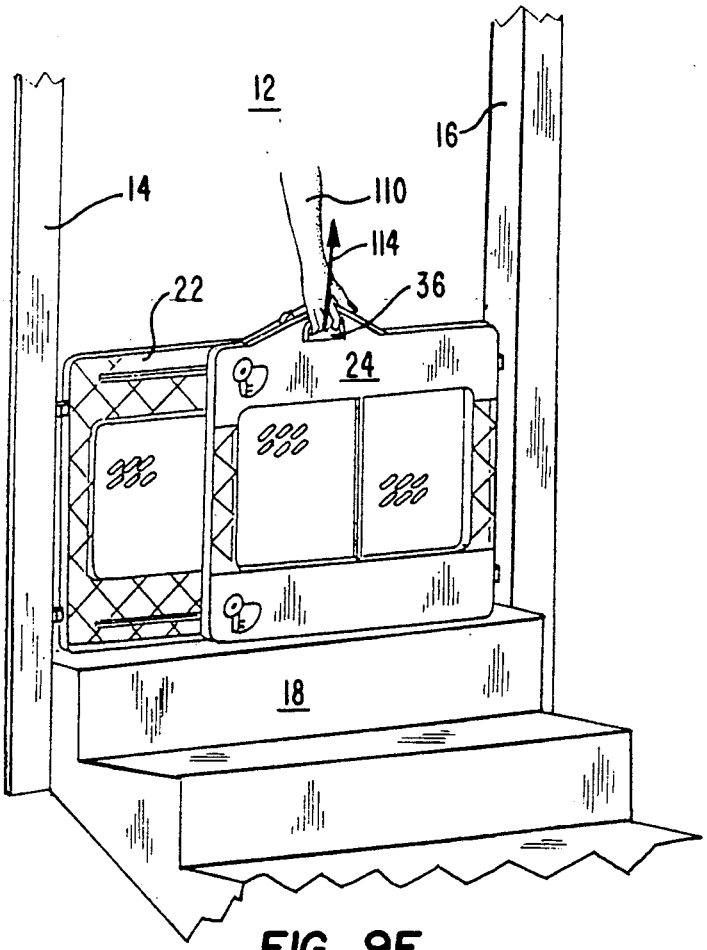

Sixth, the user, as shown in FIG. 9F, exerts upward pressure on handle 36 in the direction of arrow 114 and places the security gate back within the doorway 12 so that the plunger assemblies 26 and 28 clear the vertical door jamb 16. Thumb pressure should continue to be exerted on the either handle release button 38 as the user 110 pulls up on handle 36.

Seventh, and lastly, as also shown in FIG. 9F, once the security gate is in position between door jambs 14 and 16, the user 110 releases hand pressure on handle 36. The plunger assemblies 26 and 28 will then urge the pressure pads 30 against the vertical jamb 16 thereby firmly holding the security gate 10 in position across the doorway 12. As previously discussed, the link slots 64 and 98 permit the plunger assemblies 26 and 28 to accommodate irregular door jamb surfaces 16.

Figure 9G:
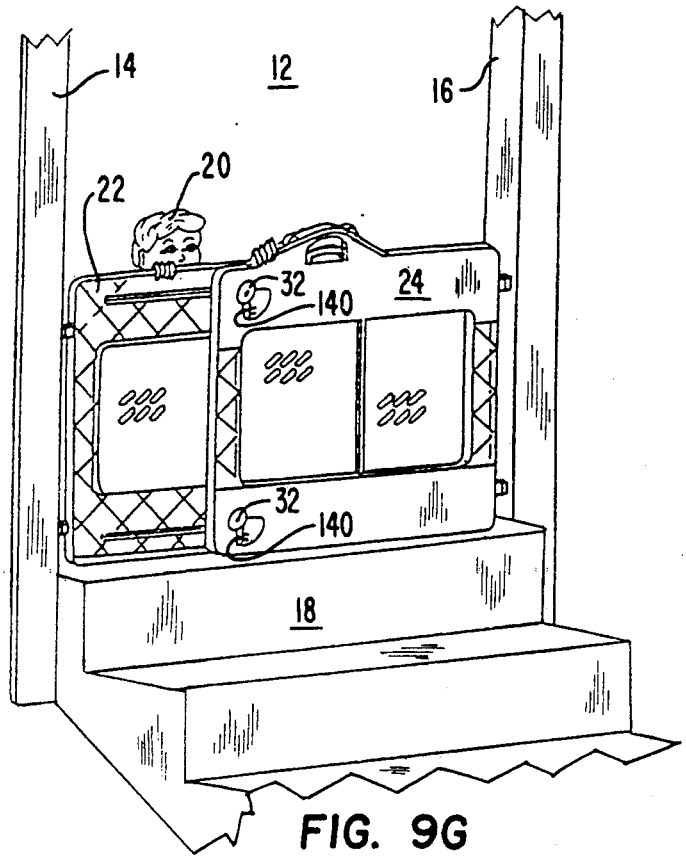
FIG. 9G is a perspective view of the gate showing it installed in a door frame in a manner similar to that of FIG. 1.

The security gate is illustrated in its fully installed mode across a doorway 12 in FIG. 9G. It would be relatively difficult for a child 20 to accidentally release the gate for several reasons. First, it would be difficult for the child 20 to accidentally release the plungers 26 and 28. In order to do so the child would have to be relatively strong and have relatively broad hands in order to push down on either handle release interlock button 38 and simultaneously pull up with approximately 15 lbs. strength on handle 36. The additional spring loading on the top plunger assembly 26 with respect to the lower plunger assembly 28 gives the security gate more strength where it is normally needed, namely, at the top of the gate. Second, it would be relatively difficult for the child 20 to release the gate extension knob 32. The gate extension knob 32 is intentionally placed on the rear of the gate facing away from the child 20. In order for the child 20 to release the extension adjustment knob 32 it would be necessary for that child 20 to apply a substantial amount of pressure to resilient boss 138 thereby permitting the knob 32 to be rotated in the counterclockwise direction towards its unlocked position. The depression of boss 138 would have to be performed simultaneous with the rotation of knob 32 in order to bring the gate into its unlocked extendable mode. It is well known that it is impossible to create a security gate that is absolutely safe under all conditions, however, the present gate is believed to be significantly more safe than many other prior art gates due to its unique use of extension and handle interlocks which provide additional security by virtue of the fact that they require at least two distinct separate actions to be carried out by a moderately strong individual.

Figure 9H:
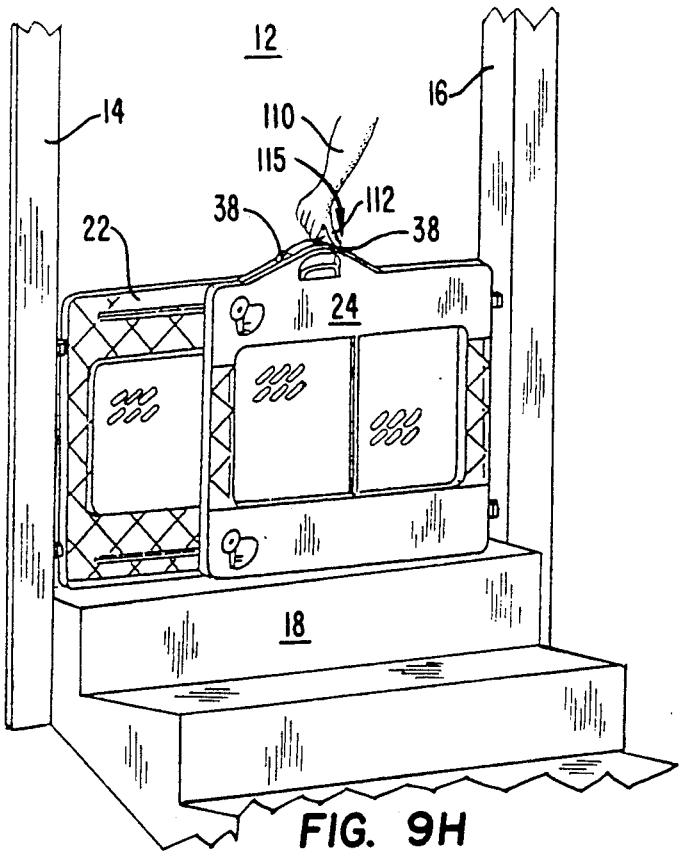
FIGS. 9H and 9I illustrate the steps necessary to remove the gate from the door frame.
Figure 9I:
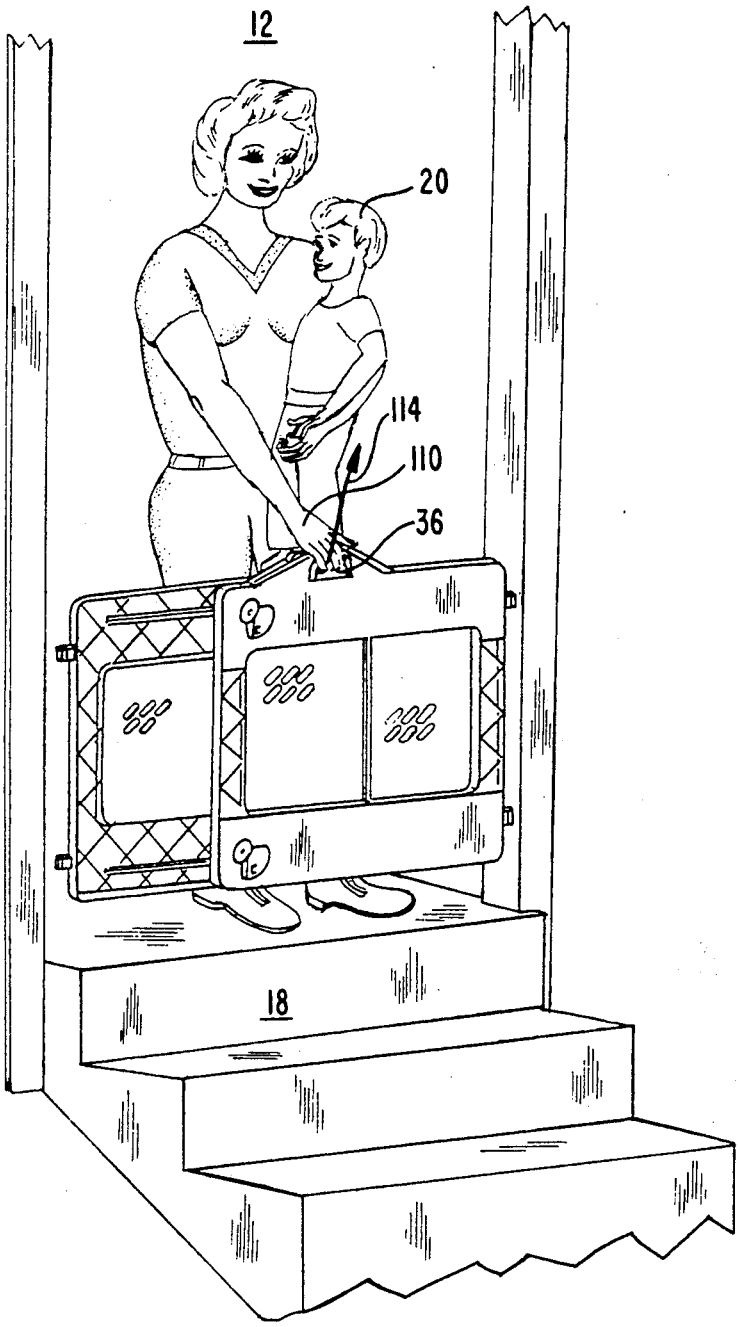

Removal of the security gate from the doorway 12 is accomplished by following the steps illustrated in FIGS. 9H and 9I.

First, the user 110 presses down with his or her thumb in the direction of arrow 115 on either handle release interlock button 38 in the manner shown in FIG. 9H.

Second, as shown in FIG. 9I, the user 110 pulls up on handle 36 in the direction of arrow 114, while keeping pressure on either interlock release button 38, thereby withdrawing plunger assemblies 26 and 28 from contact with door jamb 16. The gate can then be lifted without changing hands, removed and stored until use is required again. If the user 110 intends to use the security gate at the same doorway 12, then it is not necessary for the user 110 to repeat the coarse extension adjustment steps illustrated and described with respect to FIGS. 9A–9F. However, if a different doorway is contemplated, then it would be necessary for the user to repeat the steps illustrated in FIGS. 9A–9F in order to accommodate a different width door frame.

While the invention has been described with reference to the preferred embodiment thereof, it will be appreciated by those of ordinary skill in the art that various modifications can be made to the structure and parts of the invention without departing from the spirit and scope of the invention as a whole.

I claim:

1. A security gate apparatus for attachment across an opening having at least one vertical portion, said apparatus comprising:

a first gate panel;

a second gate panel;

gate extension adjusting means slidingly connecting said first and second gate panels together and releasably securing the extension of said gate apparatus;

retractable engaging means housed within said first panel for securely engaging said vertical portion, said retractable engaging means being operable independently of said first and second panels;

release means separate from said gate extension adjusting means operatively connected to said retractable engaging means for operating said retractable engaging means; and at least one spring means attached to said retractable engaging means for biasing said retractable engaging means against said vertical portion.

2. The security gate apparatus according to claim 12, wherein said retractable engaging means is connected to linkage means housed within said first panel, said linkage means being operable independently of said first and second panels.

* * * * *